United States Patent [19]

Smith

[11] Patent Number: 5,036,501

[45] Date of Patent: Jul. 30, 1991

[54] CLOCK ASSEMBLY

[76] Inventor: Magel Smith, 4104 Laurel Village Dr., Richmond, Va. 23228

[21] Appl. No.: 564,114

[22] Filed: Aug. 8, 1990

[51] Int. Cl.[5] ..... G04B 37/00

[52] U.S. Cl. ..... 368/88; 368/276; 368/316

[58] Field of Search ..... 368/88, 276, 309, 316–317; D10/1, 167.8, 24–27

[56] References Cited

U.S. PATENT DOCUMENTS

| | | | |
|---|---|---|---|
| D. 94,148 | 12/1934 | Kent | D10/1 |
| D. 261,869 | 11/1981 | Boukma | D10/16 |
| 1,815,796 | 7/1931 | Prevost | 368/316 |
| 1,831,261 | 11/1931 | Poole | 368/276 |
| 3,008,288 | 11/1961 | Marti et al. | 368/276 |
| 3,715,882 | 2/1973 | Ohde | 368/276 |
| 3,747,319 | 7/1973 | Riba | 368/276 |
| 260,544 | 7/1982 | Davies | 368/276 |

OTHER PUBLICATIONS

"Trend Clocks" Flyer, 10/15/81.

"Old Clocks and Matches and Their Makers", E. R. Dutton & Co., New York, 1956, pp. 84–85.

*Primary Examiner*—Vit W. Miska

*Attorney, Agent, or Firm*—Leon Gilden

[57] ABSTRACT

A clock assembly organization including a clock head removably mounted to a pedestal assembly enabling the clock to be mounted either onto a vertical or horizontal support surface by selective securement of the clock head to the pedestal assembly.

6 Claims, 4 Drawing Sheets

CLOCK ASSEMBLY

BACKGROUND OF THE INVENTION

1. Field of the Invention

The field of invention relates to clock assemblies, and more particularly pertains to a new and improved clock assembly wherein the same enables the selective securement of a pedestal to a clock head and further enables selective replacement of clock faces relative to the clock head.

2. Description of the Prior Art

Clocks of various configurations have been presented in the prior art and their organizations have included a myriad of structures to house various clock works therewithin. It has heretofore been relatively costly for individuals to utilized a clock in various portions of a household by employing pedestal as well as hanging clocks. The instant invention attempts to overcome the prior art by setting forth a clock assembly that enables selective removal of an associated pedestal assembly relative to a clock head, as well as the replacement of various clock faces to effect structural and cosmetic changes of the clock to suit various interior configurations. Examples of prior art clock structures may be found in various Design Patents as exemplified by U.S. Pat. No. Des. 59,896 to Karp, U.S. Pat. No. Des. 65,782 to Gilchrist, U.S. Pat. No. Des. 68,153 to Morris, U.S. Pat. No. Des. 223,382 to Murray, and U.S. Pat. No. Des. 250,251 to Stuart. The patents set forth various configurational organizations for a clock, but as noted, fail to teach the selective removal and replacement of various clock components relative to the structures set forth within the patents.

SUMMARY OF THE INVENTION

In view of the foregoing disadvantages inherent in the known types of clock structures now present in the prior art, the present invention provides a clock assembly wherein the same enables selective removal of a pedestal relative to a clock head, as well as selective replacement of clock face plates relative to the clock head. As such, the general purpose of the present invention, which will be described subsequently in greater detail, is to provide a new and improved clock assembly which has all the advantages of the prior art clock structures and none of the disadvantages.

To attain this, the present invention comprises a clock head selectively securable to a pedestal assembly utilizing spaced dove tails receivable within the clock head and the securement of the dove tails within the clock head by closure of an associated pivoted cover. Alternatively, threaded fasteners may be utilized to secure projecting studs of the pedestal assembly to secure the assembly to the clock head. The clock head includes the cover with a first pivoted end and a second end wherein the second end includes a continuous projection receivable within a recess of complementary configuration within the clock head. Upon opening of the pivoted cover, the clock face plate may be slidably withdrawn relative to the clock head when the internal clock work mechanism is retracted within the clock head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clock assembly which has all the advantages of the prior art clock assemblies and none of the disadvantages.

It is another object of the present invention to provide a new and improved clock assembly which may be easily and efficiently manufactured and marketed.

It is a further object of the present invention to provide a new and improved clock assembly which is of a durable and reliable construction.

An even further object of the present invention is to provide a new and improved clock assembly which is susceptible of a low cost of manufacture with regard to both materials and labor, and which accordingly is then susceptible of low prices of sale to the consuming public, thereby making such clock assemblies economically available to the buying public.

Still yet another object of the present invention is to provide a new and improved clock assembly which provides in the apparatuses and methods of the prior art some of the advantages thereof, while simultaneously overcoming some of the disadvantages normally associated therewith.

Still another object of the present invention is to provide a new and improved clock assembly wherein the same enables selective securement of a clock pedestal assembly to a clock head and further enables selective replacement of various of face plates to the clock head, as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
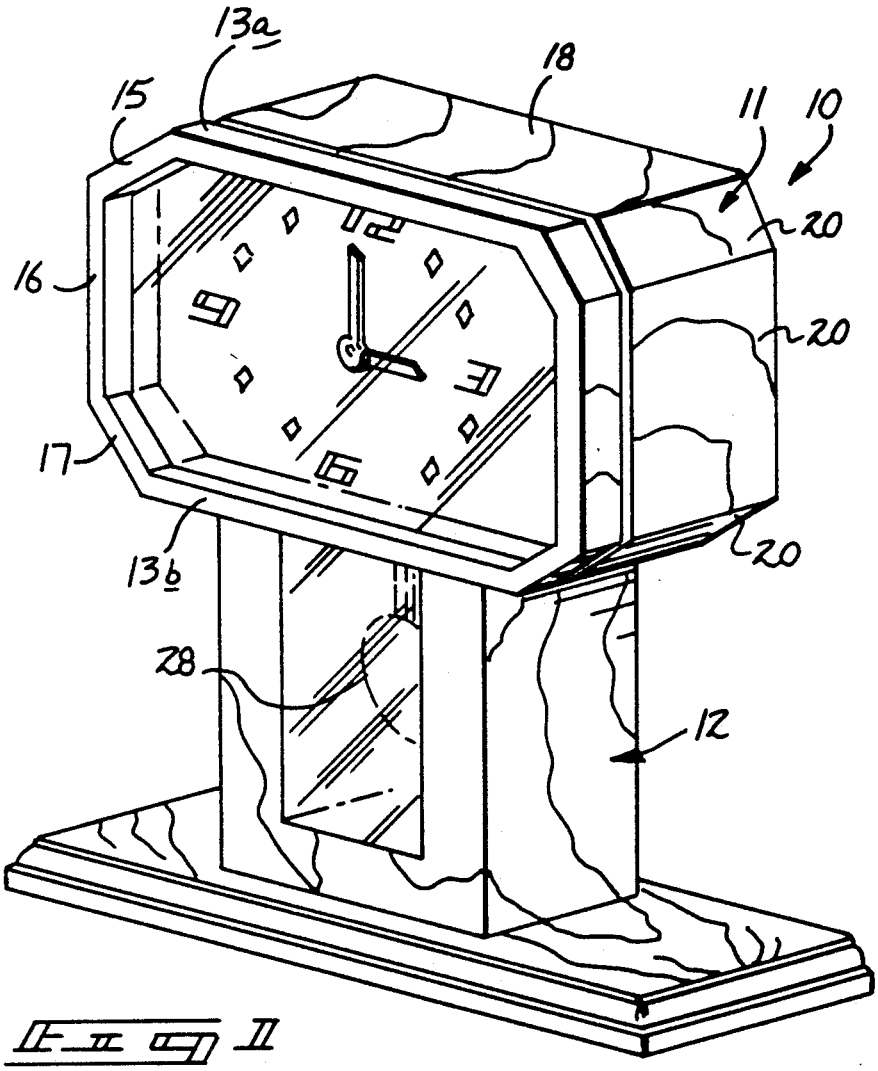
FIG. 1 is an isometric illustration of the instant invention.
Figure 2:
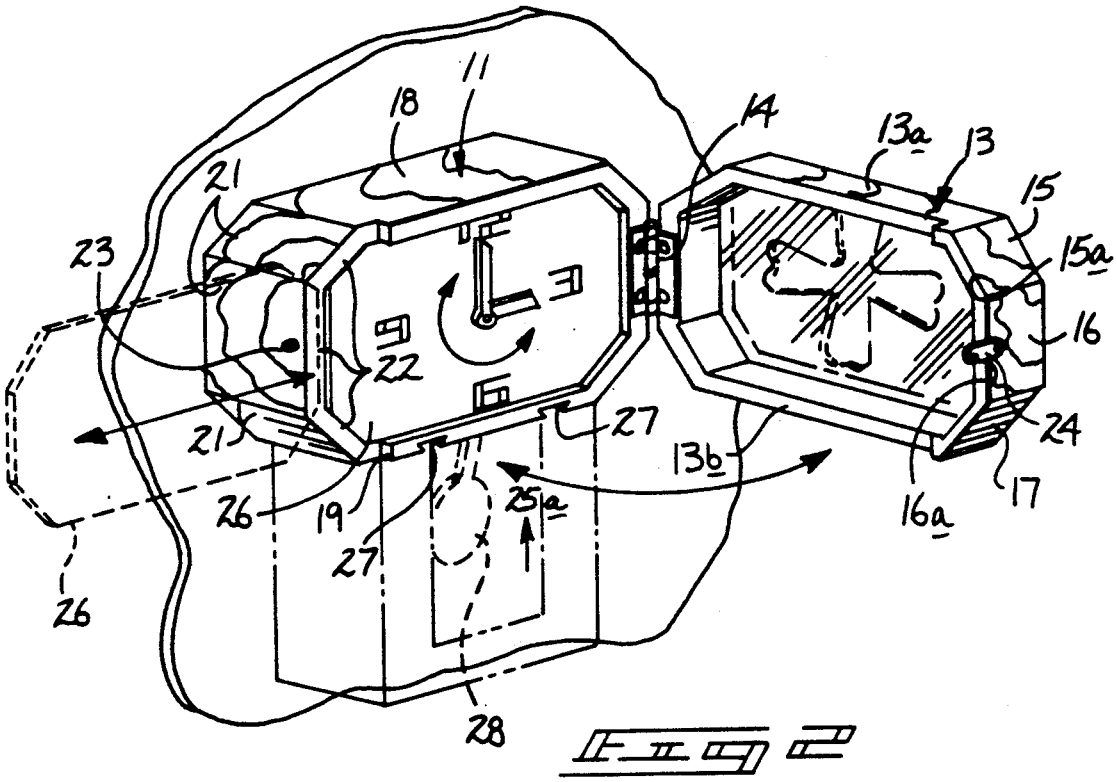
FIG. 2 is an isometric illustration of the instant invention illustrating the pivoted cover pivoted outwardly relative to the clock head.
Figure 3:
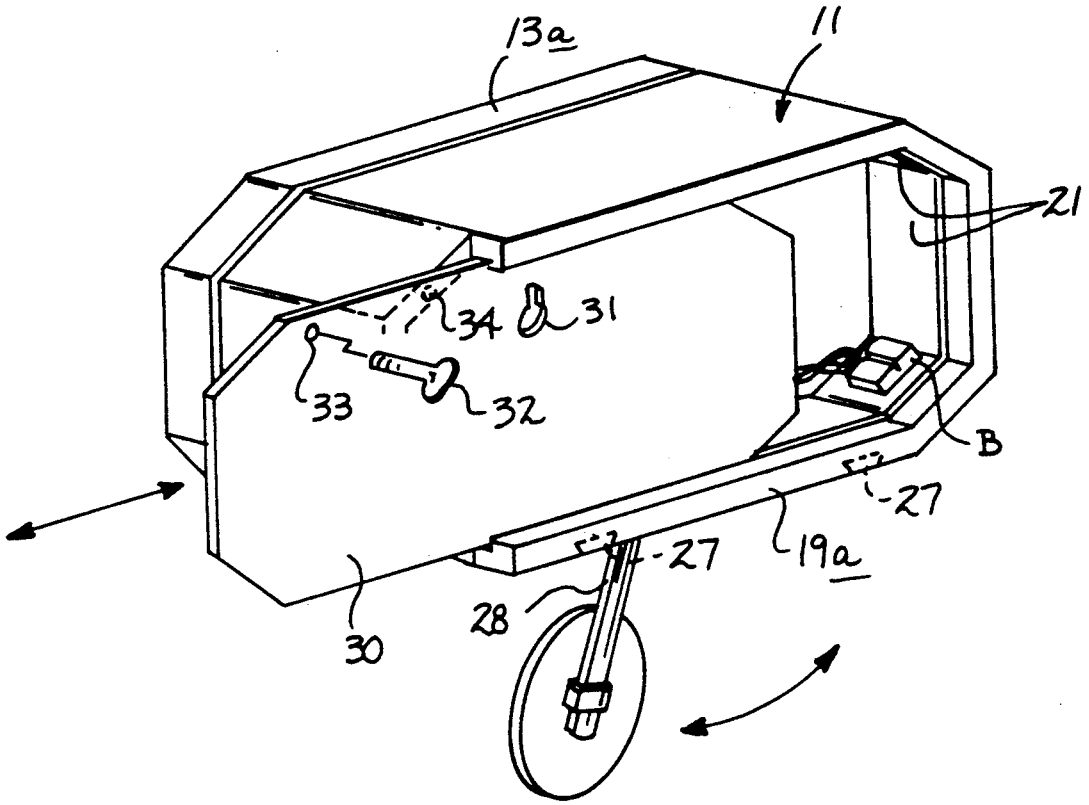
FIG. 3 is a rear orthographic view of the instant invention with the pedestal assembly removed.
Figure 4:
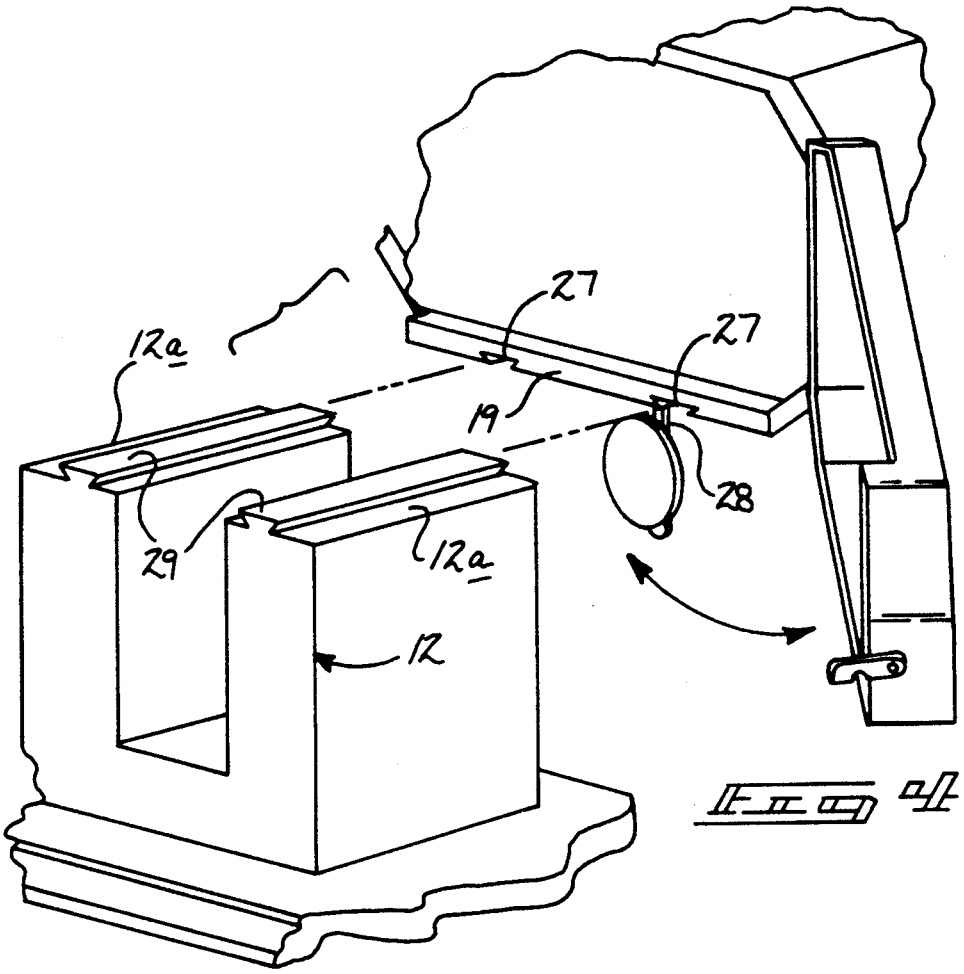
FIG. 4 is an isometric illustration of the pedestal assembly in a structural relation to the clock head.

With reference now to the drawings, and in particular to FIGS. 1 to 5 thereof, a new and improved clock assembly embodying the principles and concepts of the present invention and generally designated by the reference numeral 10 will be described.

More specifically, the clock assembly 10 essentially comprises a clock head 11 selectively secured to an underlying pedestal assembly 12. The clock head 11 includes a pivoted cover 13 mounted to the clock head by a hinge 14 mounted medially of a first end with a top wall 13*a* overlying and spaced from a bottom wall 13*b*. The first end, top wall, and bottom wall are of a first width. The pivoted cover 13 includes a second end with a projecting rear surface including a first projecting surface 15*a*, a second projecting 16*a*, and a third projecting surface 17*a* of respective end walls 15, 16, and 17 of the pivoted cover 13. The projecting surfaces 16*a* through 17*a* define a second width greater than the first width.

The clock head further includes a top clock panel 18 overlying and spaced from a clock bottom panel 19. The clock head further includes first end panels 20 of a clock's first end wall with the clock defining second end panels 21 wherein the first end panels and the clock's top and bottom panels 18 and 19 are of a third width. The clock's second end walls are defined by second end panels 21 wherein the second end panels include second end recesses 22, wherein the recesses 22 are directed inwardly of the end panels 21 of a width equal to the projections 15*a*, 16*a*, and 17*a* of the respective second end walls 15, 16, and 17. Accordingly, the clock's second end panels 21 define a fourth width less than that of the third width. The clock pivoted cover 13 includes a pivoted latch 24 secured to a latch pin 23 extending orthogonally outwardly medially of the second end panels 21.

The clock assembly 10 further includes a clock face plate 26 that is slidingly received within a groove defined by the top panel 18, bottom panel 19, and the first end panels 20. The clock face plate 26 is withdrawn from within the aforenoted groove in the direction of the indicated arrow by displacement interiorly of the clock work and removal of the clock arms associated with a typical movement. It is contemplated that conventional quartz clock movements be utilized to enable ease of component displacement in use of the invention. Upon removal of the clock head 11 from the base, the clock face 26 is removed as well as the transparent pendulum plate 25 slidingly in the direction of arrow 25*a*.

The clock bottom panel 19 includes a plurality of spaced dove tail recesses 27 oriented parallel to one another and positioned into a bottom surface of the bottom panel 19 and extending parallel to the end panels 20 and 21 respectively. A conventional pendulum 28 is associated with the clock head 11 and is pivoted for movement within the bifurcated pedestal assembly 12.

The pedestal assembly 12 includes top surfaces 12*a* aligned with and parallel to one another and formed at the upper ends of the bifurcated legs of the pedestal assembly 12 with upwardly extending dove tails 29 extending across the width of the top surfaces 12*a* for reception within the dove tails 27 of the bottom panel 19. The removal of the pedestal assembly 12 merely involves the opening of the pivoted cover 13 to an open or second position relative to a closed or first position, as illustrated in FIG. 1, to expose the dove tails 27. The dove tails 27 extend less than the complete width of the clock head 11 and are defined by a bottom wall abutment wall 19*a* to secure the dove tails and enclose them within the abutment wall 19*a* and the pivoted cover 13 when the pivoted cover is in a first position.

The clock assembly further includes a rear face plate 30 received within a rear groove formed within the top panel 18, bottom panel 19, and the second end panels 21 to enable access to the clock work interiorly of the clock head and for replacement of batteries "B", as typically utilized in association with electrically motivated clock movements. The rear face plate 30 includes a key hole support opening 31 for support of the face plate 30 and the associated clock head 11 to a vertical support surface with a lock pin 32 directed through a rear face plate opening 33 that is aligned with a rear clock head opening 34 when, the rear face plate 30 is slidably received within the rear groove, as noted above.

Figure 5:
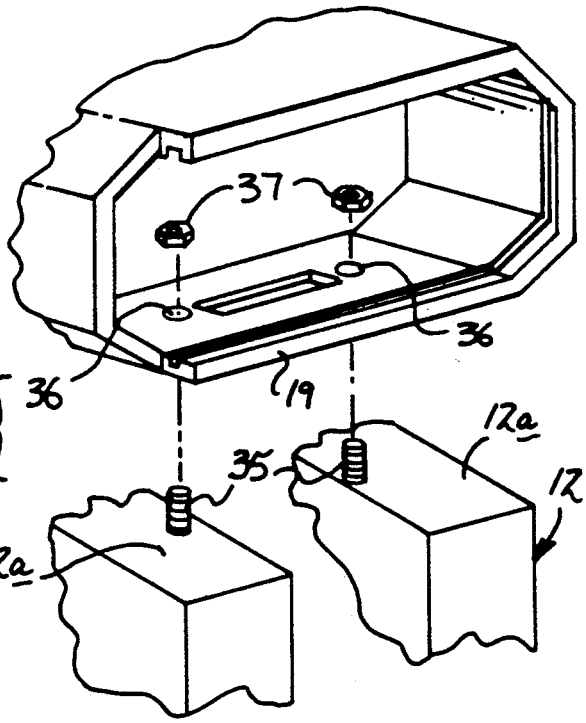
FIG. 5 is an isometric illustration of an alternative securement structure of the pedestal assembly to the clock head.

An alternative means of securing the pedestal assembly 12 to the clock head 11 includes a plurality of threaded studs 35 extending upwardly and orthogonally relative to the upper surfaces 12*a* of the pedestal assembly 12 for reception within bottom wall openings 36 in securement therein by fasteners 37, as illustrated in FIG. 5 for example.

As to the manner of usage and operation of the instant invention, the same should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A clock assembly comprising, a polygonal clock head including a top panel overlying and spaced from a bottom panel, and at least one first end panel spaced from at least one opposed second end panel to define an enclosure, and said clock head further including a replaceably mounted clock face within said clock head, and a polygonal pivoted cover with a perimeter configuration equal to that defined by the clock head, and a pedestal assembly removably mounted to the bottom panel of the clock head, and wherein the pivoted cover includes a first end wall including a hinge wherein the hinge is mounted to the first end panel of the clock head, and the first end wall is spaced from a second end wall, and the second end wall is of a second width greater than a first width defined by the first end wall, and the second end panel includes a forwardly oriented recess to receive the second end wall therein, and wherein the second end panel is of a width less than the first end panel to define said recess, and wherein the clock face is slidably mounted within a forward groove formed within the top panel, first end panel, and the second end panel of the clock head.

2. A clock assembly as set forth in claim 1 further including a rear face plate slidably received within a rear groove formed within the top panel, second end panel, and bottom panel of the clock head.

3. A clock assembly as set forth in claim 2 wherein the rear face plate includes a lock pin received within a rear face plate opening aligned with a rear clock head opening formed within the first end panel, and the lock pin being slidably mounted within the rear face plate opening and rear clock head opening to enable removal of the lock pin and enable a sliding removal of the rear face plate from within the rear groove to enable access interiorly of the enclosure.

4. A clock assembly as set forth in claim 3 wherein the bottom panel includes a plurality of spaced dove tail recesses formed within the bottom surface of the bottom panel, and the pedestal assembly includes a bifurcated plurality of legs extending upwardly including spaced and aligned top surfaces, and the top surfaces include upwardly extending dove tails slidably received within the dove tails grooves.

5. A clock assembly as set forth in claim 4 wherein the second end wall of the pivot cover includes a pivoted latch for selective securement with an outwardly extending lock pin integrally formed to the second end panel of the clock head to secure the clock face and pedestal assembly to the clock head when the pivoted closure is secured to the clock head.

6. A clock assembly as set forth in claim 5 further including a pendulum pivotally mounted through said clock head and directed downwardly through the bottom panel and mounted for movement between the bifurcated legs of the pedestal assembly when the pedestal assembly is secured to the clock head.

* * * * *